United States Patent [19]

Whipple

[11] Patent Number: 4,807,316

[45] Date of Patent: Feb. 28, 1989

[54] DUST RUFFLE

[76] Inventor: Glendola R. Whipple, 2180 St. Francis Dr., Ann Arbor, Mich. 48104

[21] Appl. No.: 124,685

[22] Filed: Nov. 24, 1987

[51] Int. Cl.[4] ..... A47C 21/00

[52] U.S. Cl. ..... 5/493; 5/498

[58] Field of Search ..... 5/493, 482, 495, 488, 5/498; 160/330; 211/180

[56] References Cited

U.S. PATENT DOCUMENTS

| | | | |
|---|---|---|---|
| D. 280,169 | 8/1985 | Heary . | |
| 2,245,779 | 6/1941 | Heil | 5/493 |
| 2,546,478 | 3/1951 | Sims | 160/330 |
| 3,144,666 | 8/1964 | Mazera et al. . | |
| 3,999,233 | 12/1976 | Morris . | |
| 4,141,097 | 2/1979 | Levinsohn . | |
| 4,386,439 | 6/1983 | Roccograndi et al. | 5/493 |
| 4,461,049 | 7/1984 | Hammond . | |
| 4,499,133 | 2/1985 | Prince | 5/482 |
| 4,587,683 | 5/1986 | Gardiner | 5/493 |

FOREIGN PATENT DOCUMENTS

| | | | |
|---|---|---|---|
| 1404365 | 8/1975 | United Kingdom | 5/493 |

*Primary Examiner*—Alexander Grosz
*Assistant Examiner*—Eric K. Nicholson
*Attorney, Agent, or Firm*—Harness, Dickey & Pierce

[57] ABSTRACT

An improved dust ruffle which can be placed on the bedding without first removing the bedding mattress from the box spring. The dust ruffle has interlining strips which are tucked between the mattress and box spring around the perimeter of the bed. The inside edge of the interlining has a relatively inelastic tape sewn to it which is used for straightening the dust ruffle by exerting tension on it. Pull loops may be provided attached to the tape at the inside corners of the interlining to facilitate tensioning of the tape for straightening. The ends of the tape may be tied together using a knot or by crossing the ends and securing them by snap type fasteners or other fasteners.

11 Claims, 1 Drawing Sheet

DUST RUFFLE

BACKGROUND AND SUMMARY OF THE INVENTION

This invention relates to a bedding accessory and particularly to a bedding dust ruffle with improved means for applying and removing the dust ruffle from the bed.

In conventional bedding, a frame is provided which supports a box spring and mattress. In order to improve the appearance of the bed, a dust ruffle is often used having a skirt of material which covers the outer edge of the box spring and extends to the bedroom floor. A typical dust ruffle has a center rectangular interlining sheet which is shaped to conform to the top surface of the box spring, with the skirt portion attached to the interlining. In order to place the dust ruffle on the bed, it is necessary to remove the mattress, spread the dust ruffle on the box spring and then replace the mattress. A similar procedure is required to remove the dust ruffle for cleaning, redecorating, etc. Although these types of dust ruffles provide a satisfactory aesthetic appearance, the process of putting them on and taking them off the bed often requires two people, thus constituting a significant inconvenience.

As a means of facilitating placement of the dust ruffle on a bed, a number of designs have been proposed in which the center interlining sheet is removed and replaced by narrow strips of interlining material which outline the outer perimeter of the box spring and are pushed into the crease between the mattress and box spring. These designs enable the dust ruffles to be removed and replaced without moving the bed mattress. Examples of such improved dust ruffles are described by U.S. Pat. Nos. 3,999,233, and 4,141,097. These patents disclose providing an elastic band around the inside edge of the interlining strips which is intended to draw the interlining inward and maintain the skirt portion in its proper position. Another dust ruffle design is sold by Sears, Roebuck and Company, and has interlining strips which are backed by a foam layer to provide high friction with the box spring or mattress surface as a means of maintainng the skirt portion in position. Although these improved articles are generally satisfactory, they have the disadvantage that it is difficult to adjust the position of these dust ruffles and maintain them in the intended position. Furthermore, the elastic and foam materials used for the above described articles are not believed to be suited to withstand repeated machine washings.

In accordance with the present invention, an improved dust ruffle is provided having narrow interlining strips with a relatively inelastic strip or ribbon joining their inside perimeter edges. The interlining strips are tucked between the mattress and box spring. The ends of the ribbon or strip can be tied together at the head of the bed, or other fasteners, such as snap type fasteners can be used to secure their ends. A further refinement according to this invention is to provide pull loops at the corners of the inside edge of the interlining which can be grasped by the user and tugged to pull the strip taught, thus straightening the dust ruffle interlining and skirt portion.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
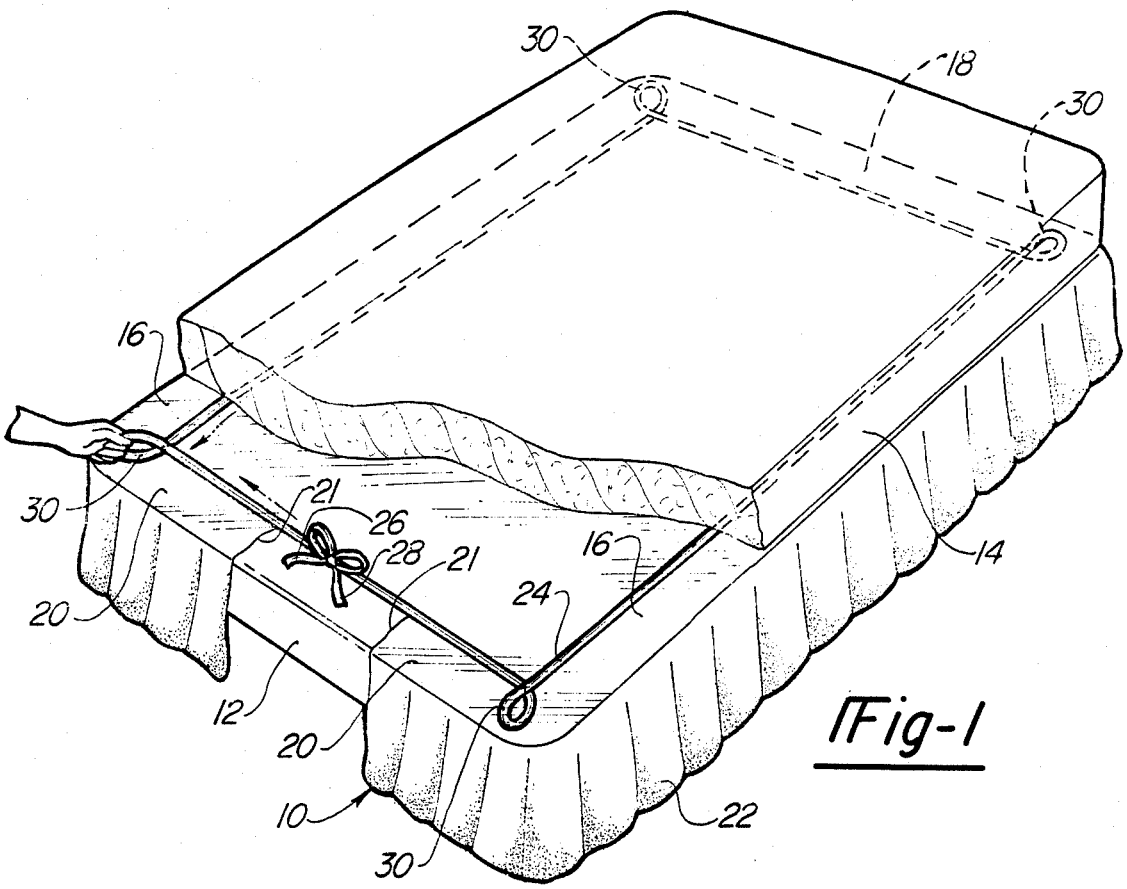
FIG. 1 is a top view of an improved dust ruffle in accordance with this invention shown positioned on a bedding box spring with a partially cut-away mattress overlying the box spring.

FIG. 1 ilustrates an improved dust ruffle in accordance with this invention which is generally designated by reference number 10. Dust ruffle 10 is shown installed on bedding box spring 12 with the associated mattress 14 shown partially cut away to enhance the clarity of the figure. Dust ruffle 10 includes fabric interlining panel segments including panel segments 16 which extend along the sides of the bed, panel segment 18 at the base of the bed, and a pair of partial interlining panel segments designated by number 20 at the head of the bed which have free ends 21. Interlining panel segments 16 through 20 are made from a soft cloth or net-like fabric of wash and dry material and preferably have a width of about six inches. The panel segments can be made of separate pieces or a single continuous length of fabric. When dust ruffle 10 is placed in position, interlining panel segments 16 through 20 extend between box spring 12 and mattress 14. The corners formed by the interlining panels can be seamed together at their corners using pleats, or are mitered or gathered.

Skirt 22 extends downward from the outer edge of interlining panel segments 16 through 20, and extends to touch or nearly touch the bedroom floor (one inch above the floor is preferred). Skirt 22 can have any desired decorative appearance and would preferably be made from a wash and dry material. Skirt 22 is split at its corners to provide clearance for posts of beds with exposed corner posts.

In accordance with a principal feature of this invention, strip tape 24 is sewn to the inside edge of interlining panel segments 16 through 20, as shown in the figures. Strip tape 24 can be made from various materials which resist stretching and elongation. Alternatively, strip tape 24 can be formed from double or triple folding and seaming of the material making up the interlining segments. Strip tape 24 has ends 26 and 28 which extend beyond the ends of interlining panel segments 20. Ends 26 and 28 may be tied together as shown in FIG. 1 to secure strip tape 24.

As an additional feature, strip tape 24 forms pull loops 30 at each of the four corners of the inside edges of interlining panel segments 16 through 20. Loops 30 may be made from the same material forming strip tape 24 by overlapping and seaming the tape at the corners. Pull loops 30 preferably have a length such that they do not extend beyond the edge of box spring 12 so they are not seen when dust ruffle 10 is placed on the bed. Pull loops 30 are provided as an aid in positioning of dust ruffle 10 as explained below.

When positioning dust ruffle 10 on the bed, a person holds the dust ruffle and starts at either corner at the head of the bed and moves around the bed tucking the appropriate interlining segments 16 through 20 into the crease between box spring 12 and mattress 14. Once dust ruffle 10 is completely inserted, ends 26 and 28 may be secured by knotting as shown in FIG. 1. Prior to the step of securing the ends, the dust ruffle may be straightened by grasping pull loops 30 and pulling on them to exert tension on strip tape 24, which serves to straighten that portion of the dust ruffle. Strip tape 24 is made from a material which resists elongation to enable tension to be exerted along the tape between its corners.

Dust ruffle 10 maintains its adjusted position since ends 26 and 28 are secured, and since the narrow interlining strip segments are outside of the agitation and friction areas between the mattress and box spring.

Figure 2:
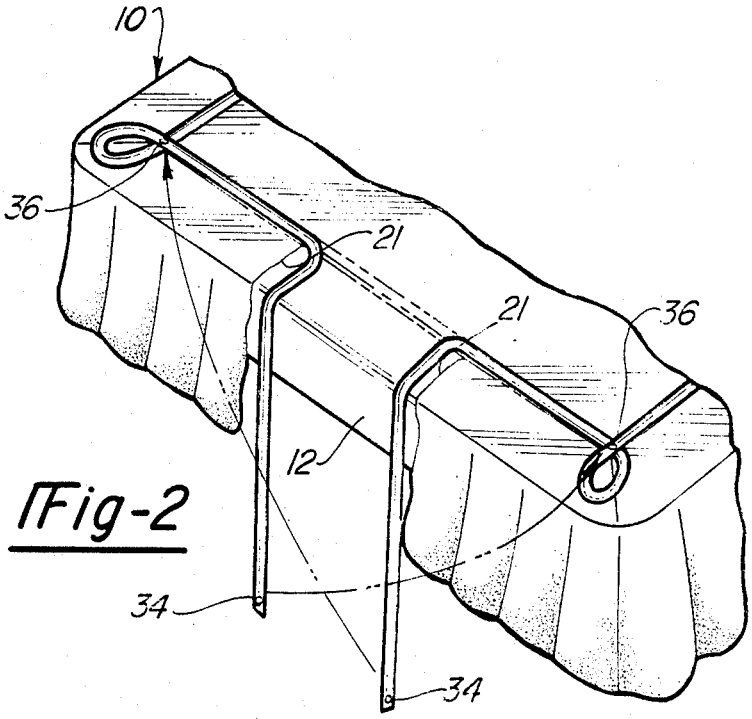
FIG. 2 is a partial pictorial view showing an alternate embodiment of the invention in which the strip tape ends are secured by snap type fasteners.

FIG. 2 illustrates an alternate embodiment of the present invention in which strip tape ends 26 and 28 are additionally provided with snap type fasteners 34. An associated mating fastener 36 is attached to strip tape 24, preferably at the corners formed by the tape. For the embodiment shown in FIG. 2, ends 26 and 28 may either be tied together, or as shown in FIG. 1, crossed and secured using the snap type fasteners as shown in FIG. 2. For either of the embodiments described above, dust ruffle 10 may be proportioned for any sizes of bedding.

While the above description constitutes the preferred embodiments of the present invention, it will be appreciated that the invention is susceptible to modification, variation and change without departing from the proper scope and fair meaning of the accompanying claims.

I claim:

1. An improved dust ruffle to be placed on bedding of the type wherein a mattress is supported by a box spring, comprising:

an interlining having an outer edge generally outlining the outer top edge perimeter of a box spring and defining an inner edge inside of said perimeter, said interlining forming two free ends and a plurality of corners, skirt portion means for extending downwardly along the outside of said box spring and joining said interlining outer edge, strip means of substantially inelastic material joining said interlining inner edge and having ends extending from said interlining free ends, said strip means provided for facilitating straightening of the dust ruffle by exerting tension on said strip means, pull loops formed by said strip means at the corners of said interlining inner edge, said pull loops adapted to be grasped by a user to exert tension on said strip means, and fastening means for the ends of said strip means ends.

2. An improved dust ruffle according to claim 1 wherein said fastening means comprises providing said strip means ends with a sufficient length to enable them to be knotted together.

3. An improved dust ruffle according to claim 1 wherein said fastening means comprises snap fasteners connected to said strip means ends.

4. An improved dust ruffle according to claim 1 wherein said strip means comprises a ribbon sewn to said interlining inner edge.

5. An improved dust ruffle according to claim 1 wherein said strip means and said pull loops comprise a ribbon sewn to said interlinng and overlapping at said corners of said interlining inner edge to form said pull loops.

6. An improved dust ruffle according to claim 1 wherein said pull loops have a length less than the width of said interlining whereby they cannot extend outside of said interlining outer edge.

7. An improved dust ruffle for bedding of the type wherein a mattress is supported by a box spring, comprising:

side interlining panel segments for positioning between a mattress and a box spring and having an outer edge coinciding with the outer edges of the top of said box spring, a first end interlining panel segment having an outer edge coinciding with the outer edge of said box spring at one end of said box spring, a pair of second end interlining panel segments forming two free ends and having outer edges coinciding with the outer edge of an opposite end of said box spring, said side, first end and second end interlining panel segments joining at the corners of said box spring and having inner edges positioned between said mattress and said box spring, skirt portion means for extending downwardly along the outside of said box spring and joining said outer edge of said interlining panel segments, relatively inelastic strip means joining said inside edges of said interlining panel segments, said strip means having ends extending from said second end interlining panel free ends for enabling said interlining panel segments and said skirt portion means to be positioned by exerting tension on said strip means, pull loops formed by said strip means adjacent the corners between said side and said first and second end interlining panel segments, and fastening means for said strip means ends.

8. An improved dust ruffle according to claim 7 wherein said fastening means comprises providing said strip means ends with a sufficient length enabling them to be knotted together.

9. An improved dust ruffle according to claim 7 wherein said fastening means comprises snap fasteners connected to said strip means ends.

10. An improved dust ruffle according to claim 7 wherein said strip means and said pull loops comprise a ribbon sewn to said interlining and overlapping at said corners of said interlining inner edge to form said pull loops.

11. An improved dust ruffle according to claim 7 wherein said pull loops have a length less than the width of said interlining whereby they cannot extend outside of said interlining outer edge.

* * * * *